US006416298B1

(12) United States Patent
Reichenmiller

(10) Patent No.: US 6,416,298 B1
(45) Date of Patent: Jul. 9, 2002

(54) RADIAL PISTON PUMP

(75) Inventor: Michael Reichenmiller, Waldstetten (DE)

(73) Assignee: ZF Batavia, L.L.C., Batavia, OH (US)

( * ) Notice: Subject to any disclaimer, the term of this patent is extended or adjusted under 35 U.S.C. 154(b) by 0 days.

(21) Appl. No.: 09/530,208

(22) PCT Filed: Nov. 2, 1998

(86) PCT No.: PCT/EP98/06927

§ 371 (c)(1),
(2), (4) Date: Apr. 26, 2000

(87) PCT Pub. No.: WO99/24712

PCT Pub. Date: May 20, 1999

(30) Foreign Application Priority Data

Nov. 5, 1997 (DE) ..... 197 48 750

(51) Int. Cl.[7] ..... F04B 1/04; F04B 27/04; F04B 39/10; F16K 17/00

(52) U.S. Cl. ..... 417/273; 417/531; 137/512.4

(58) Field of Search ..... 417/531, 273; 137/512.4, 860

(56) References Cited

U.S. PATENT DOCUMENTS 2,818,816 A * 1/1958 Christenson ..... 103/174
3,000,319 A * 9/1961 Tuck ..... 103/40
3,125,034 A * 3/1964 Lucien et al. ..... 103/174
5,645,406 A * 7/1997 Rowe et al. ..... 417/123
5,716,198 A 2/1998 Hiltemann et al. ..... 417/273

FOREIGN PATENT DOCUMENTS

| | | | |
|---|---|---|---|
| DE | 909 178 | 4/1954 | |
| DE | 26 31 799 | 1/1978 | |
| DE | 41 09 072 A1 | 9/1991 | |
| DE | 41 39 611 A1 | 6/1993 | ..... B60K/17/06 |
| DE | 41 42 032 A1 | 7/1993 | |
| DE | 43 14 217 A1 | 11/1994 | |
| DE | 43 37 144 A1 | 5/1995 | |
| DE | 43 38 641 A1 | 5/1995 | |
| DE | 195 17 628 A1 | 11/1996 | |
| GB | 1 585 788 | 3/1981 | |
| WO | WO-94/25754 | * 11/1994 | ..... F04B/1/04 |

* cited by examiner

*Primary Examiner*—Charles G. Freay
*Assistant Examiner*—Timothy P. Solak
(74) *Attorney, Agent, or Firm*—Davis & Bujold, P.L.L.C.

(57) ABSTRACT

The radial piston pump has a number of cylinder bores in a pump housing to accommodate pistons which slide into them; the cylinder bores are plugged by pressed-in stoppers (3) in which pressure channels are incorporated, all stoppers being sealed by a flat spring (6) which serves as return valve. To enlarge the outflow cross section through the pressure channels, each stopper 3 has at least one side discharge channel (8, 9).

20 Claims, 2 Drawing Sheets

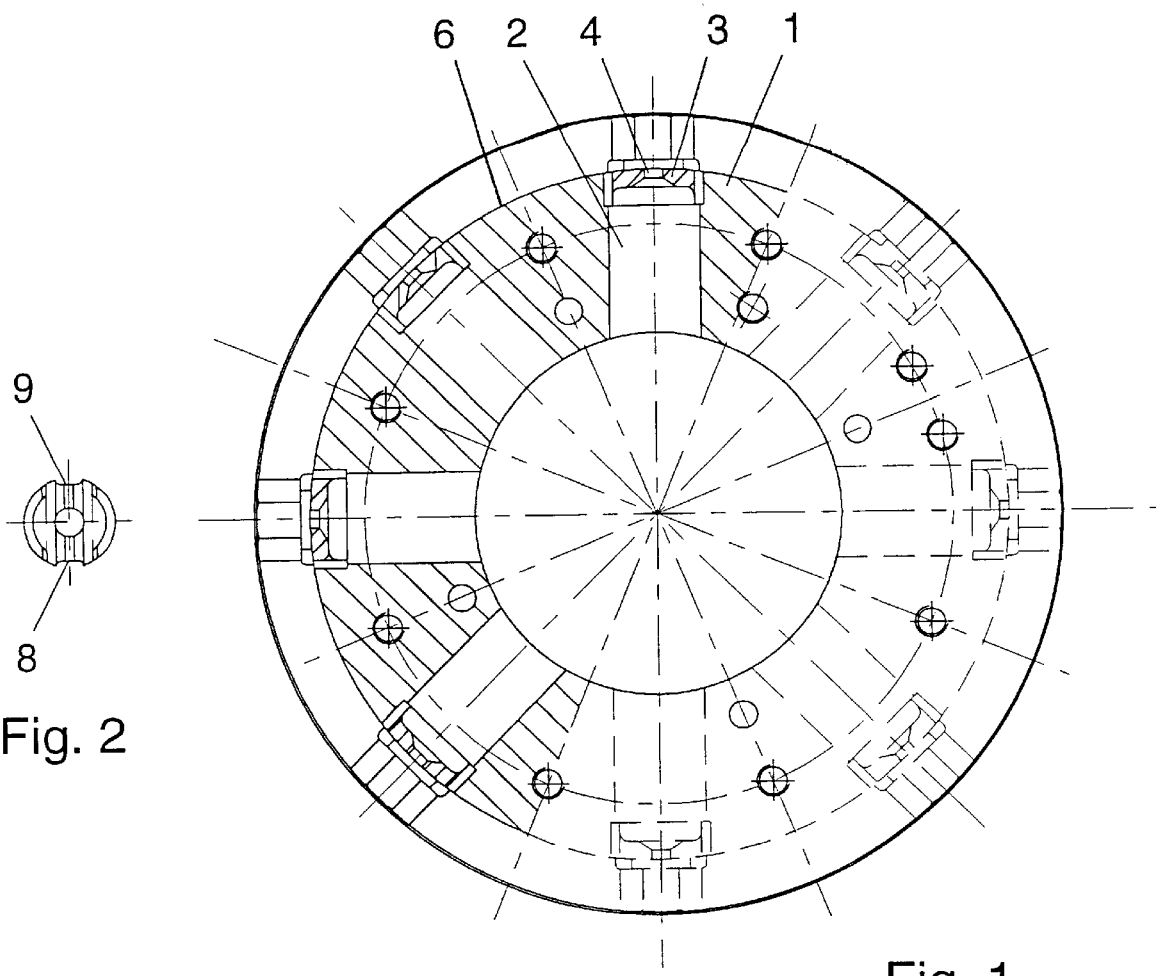
Fig. 2
Fig. 1
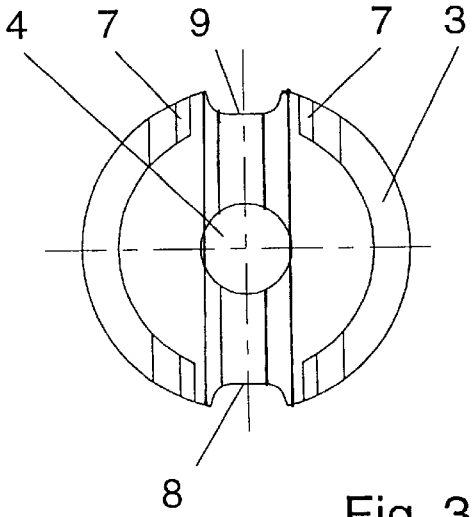
Fig. 3

RADIAL PISTON PUMP

BACKGROUND OF THE INVENTION

As part of an automatic transmission for motor vehicles, a radial piston pump has been disclosed in DE-A1 41 39 611 and serves for supply of lubricant and supply of control and actuation devices. The driving part of the radial piston pump is preferably connected with a starting device front-mounted on the transmission wherein the eccentric for driving the individual pistons can be connected, e.g. with an impeller of a hydrodynamic torque converter.

The cylinder bores of the radial piston pump are usually outwardly sealed in radial direction by a stopper which has a central through hole, all stoppers of the radial piston pump are covered by a common flat spring which acts as return valve. In order to obtain a better actuation of the flat spring by the delivery pressure, the stoppers are provided on their upper side with grooves that extend in parallel and end within the processed sealing surface of the frontal surfaces and are aligned in peripheral direction of the radial piston pump. The flat spring seals both the centrally disposed bores and the grooves against a collecting annular groove lying radially outside the stoppers. During delivery of the radial piston pump, the flat spring on those stoppers which lie in the pressure zone of the radial piston pump is lifted from the sealing surface by the pressure in the central bore and in the grooves.

In the area of the radially outwardly oriented edge of the pistons, there is situated in the pump housing, coaxially with the pump axle, a suction annular groove which cuts the cylinder bores. The cutting forms suction openings between the suction annular groove and the cylinder bores. A suction throttle is formed on each piston between the edge and the respective suction opening.

However for certain applications, it is required to enlarge the outflow cross section from the cylinder chamber.

The problem on which this invention is based is to provide a radial piston pump which, compared with the conventional radial piston pumps, has an increased outflow cross section adapted to the intended application.

SUMMARY OF THE INVENTION

According to the invention, each stopper pressed into the housing is equipped with at least one side discharge channel the diameter of which, together with that of the central bore, determines the outflow cross section; when the diameter of the central bore remains the same, the outflow cross section can be adapted to the conditions of use by adequate dimensions of the side discharge channels.

The advantage is to initially provide side discharge channels when the stopper is initially formed from a raw material, since this considerably reduces the cost of production. At the same time, the position fixing of the stoppers is made easier when pressed into the housing. The additional discharge channels offer the further advantage that the sealing flat valve has only a very small differential pressure surface and thus opens easily. The flat valve is passed as formerly in the stopper.

In the inventive radial piston pump, peripheral grooves are also provided in the housing whereby the cost of production is considerably reduced thereby preventing an adherence, i.e. a sticking of the flat valve to the housing. Instead of the peripheral grooves, individual sectors are also provided with grooves which are associated with the individual piston bores and the connection to which the stoppers make possible.

Since the stoppers are pressed into the housing in a desired direction, it is possible to economically produced twisted discharge grooves. In every case, the stoppers seal over the entire outer diameter of the cylinder bores containing the pistons, whereby the flat valve seat is not disconnected.

BRIEF DESCRIPTION OF THE DRAWINGS

Herebelow the invention is explained in detail with the aid of the drawings where advantageous embodiments are shown. The drawing shows:

FIG. 1 is a partial section through a radial piston pump with the pressed-in stoppers;

FIG. 2 is a top view on an inventively developed stopper;

FIG. 3 is an enlarged top view on said stopper;

DESCRIPTION OF THE PREFERRED EMBODIMENTS

Figure 4:
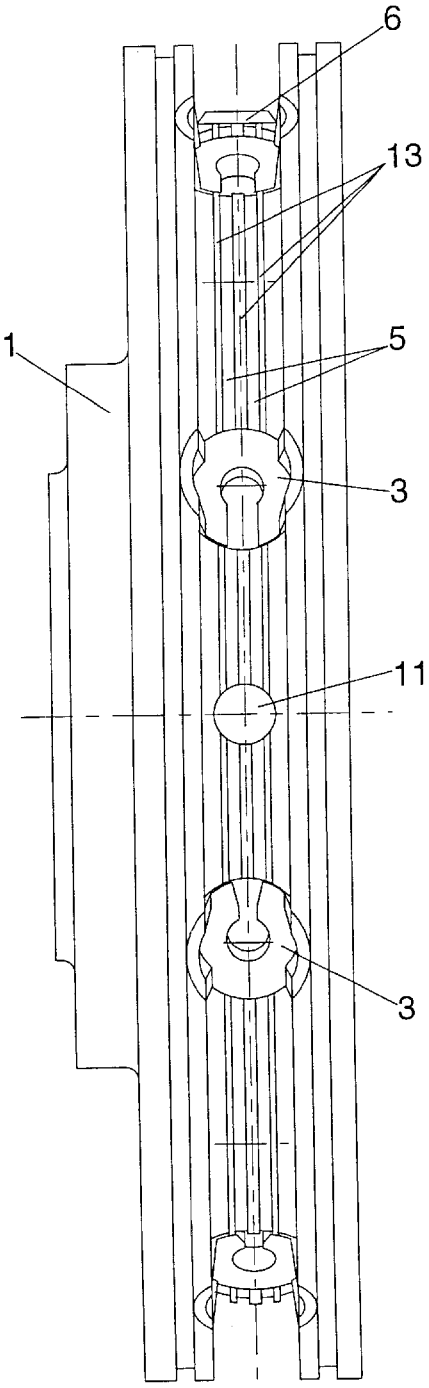
FIG. 4 is a side view of the pump housing with differently developed pressed-in stoppers.

In FIG. 1, the pump housing 1 of a radial piston pump, such as particularly used for automatic transmissions of motor vehicles is shown. In the pump housing is provided a number of radially extending cylinder bores 2 in which slide spring-loaded pistons (not shown). Each cylinder bore 2 is plugged by a stopper 3 wherein each stopper is provided with a central bore 4 and a frontal surface. On the pump housing parallel grooves 5 extend in peripheral direction of the radial piston pump and end within a sealing surface of the frontal surface.

On each stopper 3, a return valve is formed in a manner such that all stoppers are encompassed by a common flat spring 6 which seals the bores 4 and the grooves 5 against a collecting annular groove lying radially outside the stoppers 3. During delivery of the radial piston pump the flat spring 6 on those stoppers 3, which lie in the pressure zone of the radial piston pump, is lifted from the sealing surface by the pressure in the central bore 4 and in the grooves 5. With 7 are additionally designated two side belt guides for the flat spring 6.

It is now provided, according to the invention, to enlarge the outflow cross section of each stopper 3, that the latter has at least one side discharge channel. The top view on one of the stoppers, according to FIG. 2, and the enlarged representation of said stopper in FIG. 3 show that, in this case, two side discharge channels 8, 9 are provided which are diagonally opposite and placed between both side belt guides so that the flat spring 6 covers both the central bore 4 and the side discharge channels 8, 9.

Figure 5:
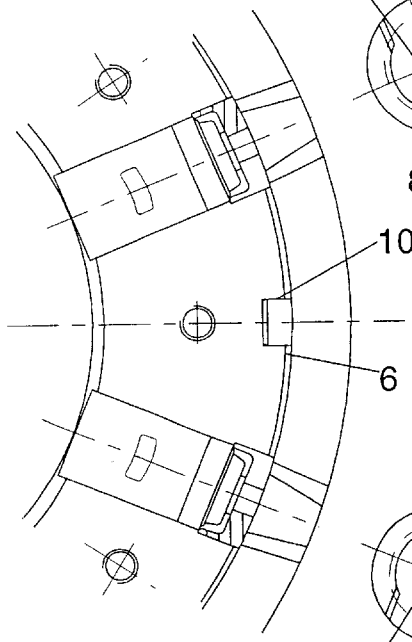
FIG. 5 is a partial section through the pump housing.
Figure 5A:
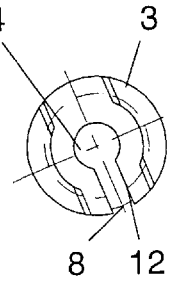
FIGS. 5A and 5B are top views on two other embodiments of inventive stoppers.
Figure 5B:
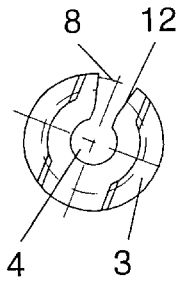

In FIG. 4 is shown a side view of the pump housing wherein, to seal the cylinder bores 2, stoppers are also pressed in which, likewise in this case, as particularly results from FIGS. 5A and 5B, together with the central bore 4 have a side discharge channel 8 connected with the central bore 4 by a connecting groove 12. According to FIG. 5A, the connecting groove 12 can have two opposite walls extending parallel with each other or side walls that extend forming an angle so that a conically shaped connecting groove 12 is formed according to FIG. 5B.

The housing 1 is provided with discharge grooves 5 already inserted in the housing blank. By the rotary directions of the discharge channels 8, a groove sector is assigned to each piston. In the design with endless grooves, if the flat spring 6 is shaped as a closed ring, then the stoppers 3 open in the same direction with the discharge channels 8. If the flat spring 6 opens, then the flat spring 6 must be secured in one sector against twisting. The sector thus can no longer be used for sealing. In this case, the stoppers 3 with discharge channels 8 are advantageously oriented symmetrically opposite each other. In the sector where the discharge channels 8 stand opposite each other, the housing grooves 5 must be interrupted by a stopper 10, 11 so that no short circuit occurs between the piston bores.

The cross sections of the side discharge channels 8, 9 are dimensioned so that the flat valve has a small differential surface and easily opens.

In the grooves 5 in the housing 1, the flat spring is supported on stems 13.

The double groove is advantageous for reducing the adherence. A "sticking" between the stoppers on the pump housing 1 is prevented by grooves or double grooves covered by the flat spring 6.

In one advantageous embodiment, as shown in FIGS. 4 and 5, the individual stoppers can be rolled of strip steel.

Reference Numerals

1 pump housing
2 cylinder bore
3 stopper
4 central bore
5 grooves
6 flat spring
7 belt guide
8 side discharge channel
9 side discharge channel
10 stopper
11 stopper
12 connecting grooves
13 belt support

What is claimed is:

1. A radial piston pump comprising:

a pump housing (1) having a plurality of radially extending cylinder bores (2) formed therein, each one of the plurality of radially extending cylinder bores (2) accommodating a piston therein, and an annular periphery of the pump housing (1) defining a pressure zone;

an eccentric for driving each one of the pistons accommodated within the plurality of radially extending cylinder bores (2);

a bore stopper (3) sealing an end of each one of the plurality of radially extending cylinder bores (2) remote from the eccentric, and each bore stopper (3) having a central bore (4) extending therethrough to provide a discharge outlet for each one of the plurality of radially extending cylinder bores (2);

a flat spring (6) encompassing the annular periphery of the pump housing (1) and accommodated within the pressure zone so that the flat spring (6) communicates with the central bores (4) of each one of the bore stoppers (3) sealing the plurality of radially extending cylinder bores (2); and the pressure zone, formed in the periphery of the pump housing (1), having at least one annular groove (5) formed therein, wherein each one of the central bores (4) of the bore stoppers (3) has at least one side discharge channel (8, 9) formed therein, the at least one side discharge channel (8, 9) extends from the central bore (4) to and directly communicates with the at least one annular groove (5) to facilitate continuous communication between the central bore (4) and the at least one annular groove (5) and minimize adherence of the flat spring (6) to the periphery of the housing (1) during operation of the radial piston pump.

2. The radial piston pump according to claim 1, wherein a pair of annular grooves (5) are formed in the pressure zone, and the pair of annular grooves (5) extend parallel to one anther about the periphery of the pump housing.

3. The radial piston pump according to claim 1, wherein each one of the central bores (4), of the bore stoppers (3), has a pair of opposed discharge channels (8, 9) formed therein and each one of the pair of opposed discharge channels (8, 9) communicates with the flat spring (6) and also communicates with the at least one annular groove (5).

4. The radial piston pump according to claim 3, wherein a separate connecting groove facilitates communication between the central bore and each of the pair of opposed discharge channels (8, 9).

5. The radial piston pump according to claim 1, wherein each one of the central bores (4), of the bore stoppers (3), has only a single discharge channel (8, 9) formed therein and the single discharge channel (8, 9) communicates with the flat spring (6) and also communicates with the at least one annular groove (5).

6. The radial piston pump according to claim 5, wherein a blocking stopper (11) is located in the pressure zone, the blocking stopper (11) communicates with the at least one annular groove to interrupt flow along the at least one annular groove, and the single discharge channels are arranged symmetrically so as to open toward the blocking stopper (11) and prevent a short circuit from occurring between adjacent central bores.

7. The radial piston pump according to claim 1, wherein the at least one side discharge channel (8, 9) has a connecting groove to facilitate communication with the central bore (4).

8. The radial piston pump according to claim 7, wherein opposed side walls of the connecting groove extend parallel to one another.

9. The radial piston pump according to claim 7, wherein opposed side walls of the connecting groove extend at an angle to one another to form a conically shaped connecting groove.

10. The radial piston pump according to claim 7, wherein opposed side walls of the connecting groove extend parallel to one another.

11. The radial piston pump according to claim 7, wherein opposed side walls of the connecting groove extend at an angle to one another to form a conically shaped connecting groove.

12. The radial piston pump according to claim 1, wherein a blocking stopper (11) is located in the pressure zone and the blocking stopper (11) communicates with the at least one annular groove to interrupt flow along the at least one annular groove.

13. The radial piston pump according to claim 1, wherein a blocking stopper is located in the pressure zone and the blocking stopper (11) communicates with the pair of annular grooves (5) to interrupt flow along the pair of annular grooves (5).

14. A radial piston pump comprising:

a pump housing (1) having a plurality of radially extending cylinder bores (2) formed therein, each one of the plurality of radially extending cylinder bores (2) accommodating a piston therein, and an annular periphery of the pump housing (1) defining a pressure zone;

an eccentric for driving each one of the pistons accommodated within the plurality of radially extending cylinder bores (2);

a bore stopper (3) sealing an end of each one of the plurality of radially extending cylinder bores (2) remote from the eccentric, and each bore stopper (3) having a central bore (4) extending therethrough to provide a discharge outlet for each one of the plurality of radially extending cylinder bores (2);

a flat spring (6) encompassing the annular periphery of the pump housing (1) and accommodated within the pressure zone so that the flat spring (6) communicates with the central bores (4) of each one of the bore stoppers (3) sealing the plurality of radially extending cylinder bores (2); and the pressure zone, formed in the periphery of the pump housing (1), having at least one annular groove (5) formed therein, wherein each one of the central bores (4) of the bore stoppers (3) has a single discharge channel (8 or 9) formed therein, the single discharge channel (8, 9) extends from the central bore (4) to and directly communicates with the at least one annular groove (5) to facilitate continuous communication between the central bore (4) and the at least one annular groove (5) and minimize adherence of the flat spring (6) to the periphery of the housing (1) during operation of the radial piston pump and the flat spring (6) covers the single discharge channel (8, 9) without hindering continuous and direct communication between the central bore (4) and the at least one annular groove (5).

15. The radial piston pump according to claim 14, wherein a pair of annular grooves (5) are formed in the pressure zone, and the pair of annular grooves (5) extend parallel to one anther about the periphery of the pump housing.

16. The radial piston pump according to claim 14, wherein the single discharge channel (8, 9) has a single connecting groove to facilitate communication with the central bore (4).

17. The radial piston pump according to claim 14, wherein a blocking stopper (11) is located in the pressure zone and the blocking stopper (11) communicates with the at least one annular groove to interrupt flow along the at least one annular groove.

18. The radial piston pump according to claim 14, wherein a blocking stopper is located in the pressure zone and the blocking stopper (11) communicates with the pair of annular grooves (5) to interrupt flow along the pair of annular grooves (5).

19. The radial piston pump according to claim 14, wherein a blocking stopper (11) is located in the pressure zone, the blocking stopper (11) communicates with the at least one annular groove to interrupt flow along the at least one annular groove, and the single discharge channels are arranged symmetrically with respect to the blocking stopper (11) to prevent a short circuit from occurring between adjacent central bores.

20. A radial piston pump comprising:

a pump housing (1) having a plurality of radially extending cylinder bores (2) formed therein, each one of the plurality of radially extending cylinder bores (2) accommodating a piston therein, and an annular periphery of the pump housing (1) defining a pressure zone;

an eccentric for driving each one of the pistons accommodated within the plurality of radially extending cylinder bores (2);

a bore stopper (3) sealing an end of each one of the plurality of radially extending cylinder bores (2) remote from the eccentric, and each bore stopper (3) having a central bore (4) extending therethrough to provide a discharge outlet for each one of the plurality of radially extending cylinder bores (2);

a flat spring (6) encompassing the annular periphery of the pump housing (1) and accommodated within the pressure zone so that the flat spring (6) communicates with the central bores (4) of each one of the bore stoppers (3) sealing the plurality of radially extending cylinder bores (2); and the pressure zone, formed in the periphery of the pump housing (1), having a pair of annular grooves (5) are formed therein, wherein each one of the central bores (4) of the bore stoppers (3) has a single discharge channel (8 or 9) formed therein, the single discharge channel (8, 9) extends from the central bore (4) to and directly communicates with the pair of annular grooves (5) to facilitate continuous communication between the central bore (4) and the pair of annular grooves (5) and minimize adherence of the flat spring (6) to the periphery of the housing (1) during operation of the radial piston pump and the flat spring (6) covers the single discharge channel (8, 9) without hindering continuous communication the central bore (4) to and directly communicates with the pair of annular grooves (5);

a blocking stopper (11) is located in the pressure zone and the blocking stopper (11) communicates with the pair of annular grooves (5) to interrupt flow along the pari of annular grooves (5); and opposed side walls of the connecting groove one of extend parallel to one another and extend at an angle to one another to form a conically shaped connecting groove.

* * * * *